US006776235B1

(12) United States Patent
England

(10) Patent No.: US 6,776,235 B1
(45) Date of Patent: Aug. 17, 2004

(54) HYDRAULIC FRACTURING METHOD

(75) Inventor: Kevin England, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 9 days.

(21) Appl. No.: 10/201,514

(22) Filed: Jul. 23, 2002

(51) Int. Cl.[7] ..... E21B 43/26
(52) U.S. Cl. ..... 166/271; 166/280; 166/308
(58) Field of Search ..... 166/280, 271, 166/308, 307, 281

(56) References Cited

U.S. PATENT DOCUMENTS

| | | | | |
|---|---|---|---|---|
| 2,774,431 A | | 12/1956 | Sherborne | 166/22 |
| 3,155,159 A | | 11/1964 | McGuire et al. | 166/29 |
| 3,235,007 A | | 2/1966 | Kern et al. | 166/42 |
| 3,378,074 A | | 4/1968 | Kiel | 166/42 |
| 3,664,420 A | | 5/1972 | Graham et al. | 166/280 |
| 3,896,877 A | * | 7/1975 | Vogt et al. | 166/250.1 |
| 3,933,205 A | | 1/1976 | Kiel | 166/308 |
| 4,068,718 A | * | 1/1978 | Cooke et al. | 166/280 |
| 4,109,721 A | | 8/1978 | Slusser | 166/280 |
| 4,509,598 A | | 4/1985 | Earl et al. | 166/308 |
| 4,695,389 A | | 9/1987 | Kubala | 252/8.553 |
| 4,725,372 A | | 2/1988 | Teot et al. | 252/8.514 |
| 5,009,797 A | * | 4/1991 | Penny et al. | 507/211 |
| 5,036,919 A | | 8/1991 | Thomas et al. | 166/271 |
| 5,054,554 A | | 10/1991 | Pearson | 166/280 |
| 5,095,987 A | * | 3/1992 | Weaver et al. | 166/276 |
| 5,501,275 A | * | 3/1996 | Card et al. | 166/280 |
| 5,551,514 A | * | 9/1996 | Nelson et al. | 166/280 |
| 5,551,516 A | | 9/1996 | Norman et al. | 166/308 |
| 5,597,043 A | | 1/1997 | Stadulis | 166/280 |
| 5,908,073 A | * | 6/1999 | Nguyen et al. | 166/276 |
| 5,964,295 A | | 10/1999 | Brown et al. | 166/308 |
| 5,979,557 A | | 11/1999 | Card et al. | 166/300 |
| 6,172,011 B1 | * | 1/2001 | Card et al. | 507/204 |
| 6,286,600 B1 | | 9/2001 | Hall et al. | 166/305 |

FOREIGN PATENT DOCUMENTS

WO WO98/56497 6/1998

OTHER PUBLICATIONS

Mayerhofer, M.J. *Proppants? We Don't Need No Proppants,* SPE Paper 38611 presented at the 1997 Annual Technical Conference and Exhibition held in San Antonio, Texas Oct. 5–8 1997.

Willberg, D., et al., *Optimization Of Fracture Cleanup Using Flowback Analysis,* SPE Paper 39920, presented at the 1998 SPE Rocky Mountain regional/Low Permeability Reservoirs Symposium and Exhibition held in Denver, Colorado, Apr. 5–8 1998.

Anderson, A., *Production Enhancement Through Aggressive Flowback Procedures In The Codell Formation,* SPE paper 36468 presented at the 1996 SPE Annual Technical Conference and Exhibition held in Denver, Colorado, Oct. 6–9 1996.

Willberg, D., et al. *Determination Of The Effect Of Formation Water On Fracture Fluid Cleanup Through Field Testing In The East Texas Cotton Valley,* SPE paper 38620 presented at the 1997 SPE Annual Technical Conference and Exhibition held in San Antonio Oct. 5–8 1997.

* cited by examiner

*Primary Examiner*—Roger Schoeppel
(74) *Attorney, Agent, or Firm*—Thomas O. Mitchell; Robin Nava; Brigitte L. Echols

(57) ABSTRACT

This invention relates generally to the art of hydraulic fracturing in subterranean formations and more particularly to a method and means for optimizing fracture conductivity. According to the present invention, the well productivity is increased by sequentially injecting into the wellbore alternate stages of fracturing fluids having a contrast in their ability to transport propping agents to improve proppant placement, or having a contrast in the amount of transported propping agents.

18 Claims, 7 Drawing Sheets

*Prior Art*
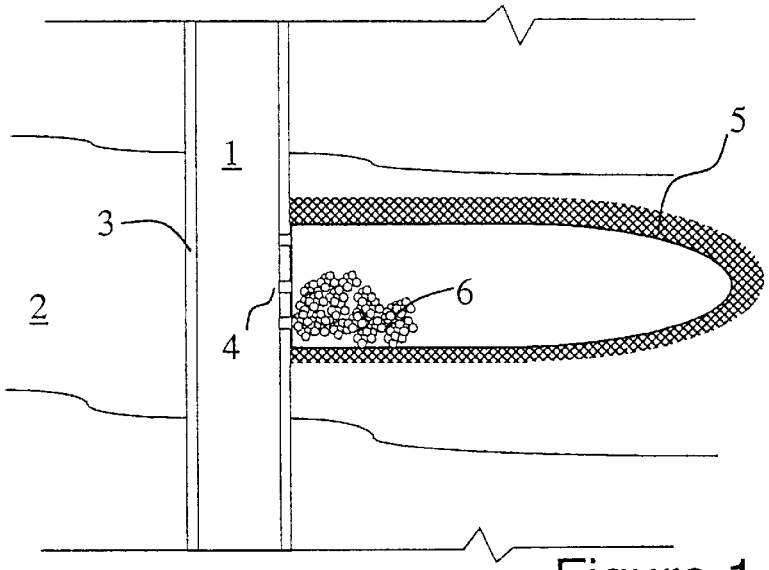
Figure 1-A
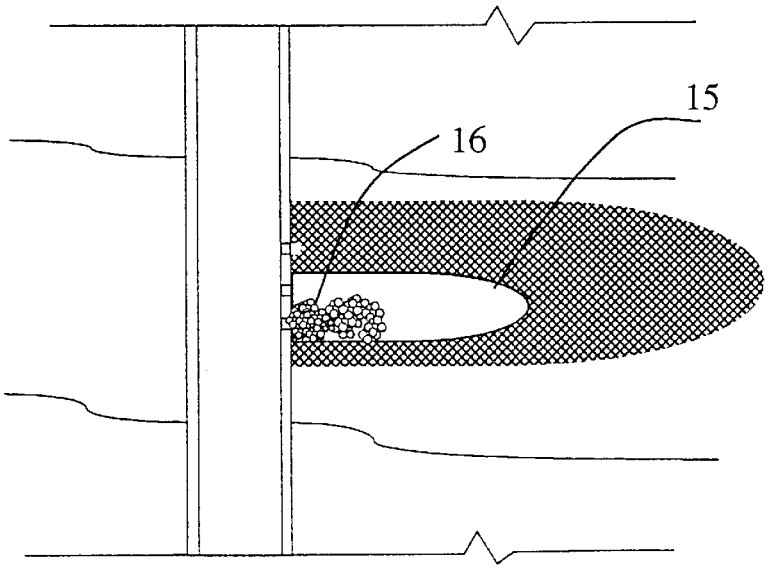
Figure 1-B

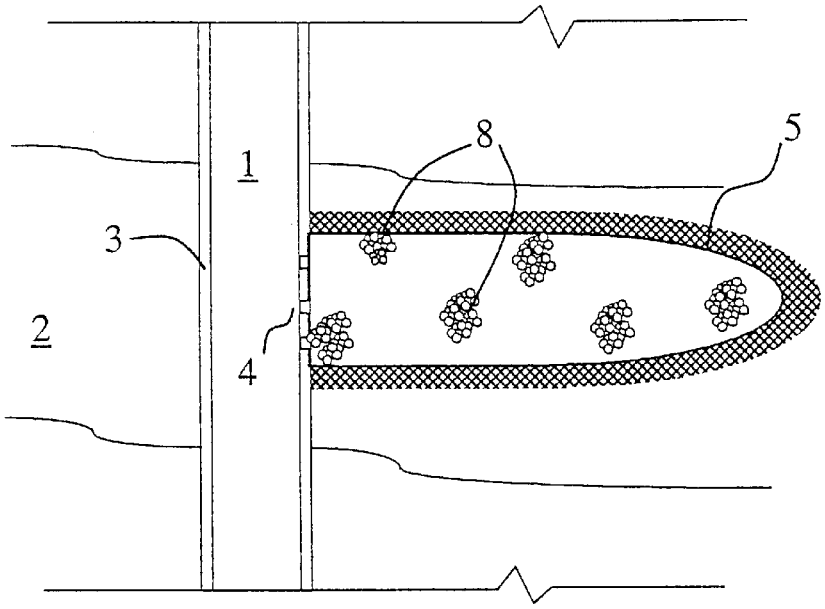
Figure 2-A
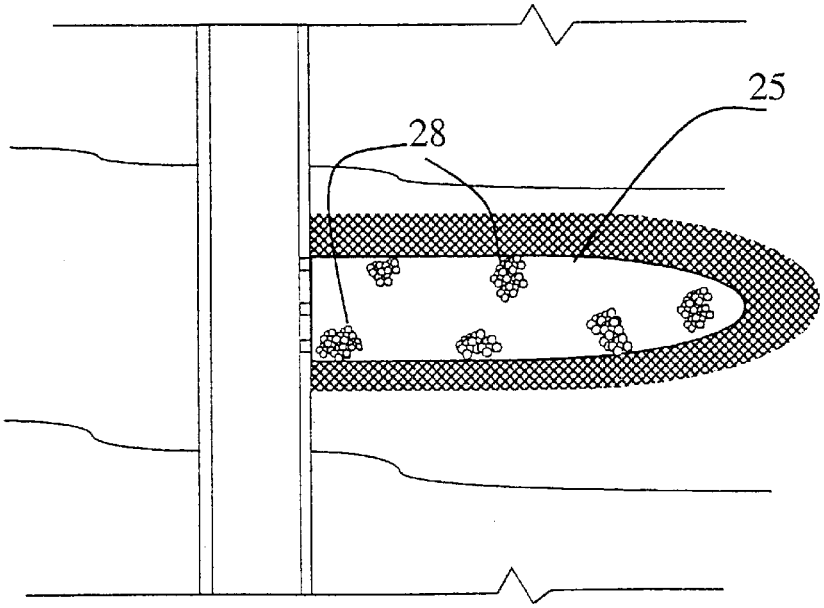
Figure 2-B

Prior Art
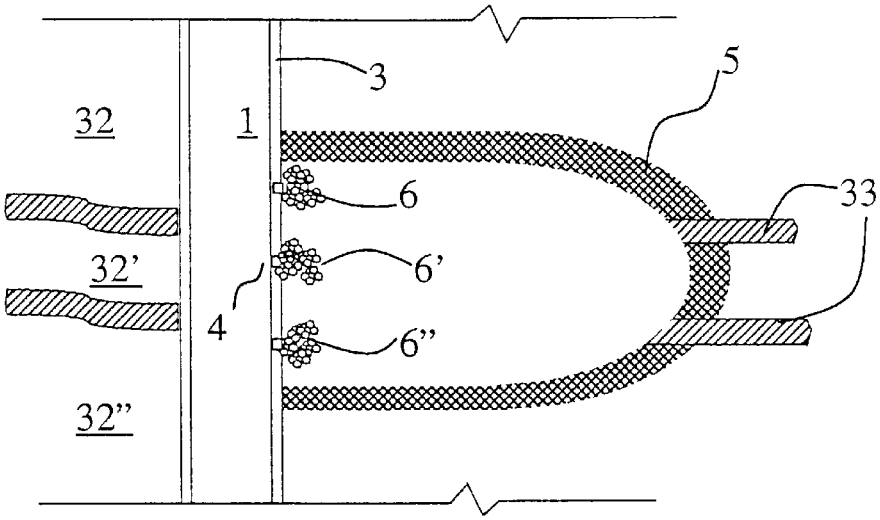
Figure 3-A
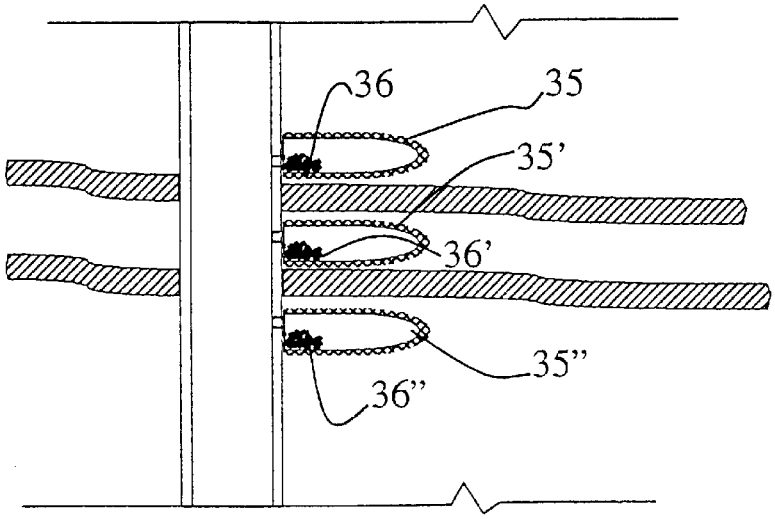
Figure 3-B

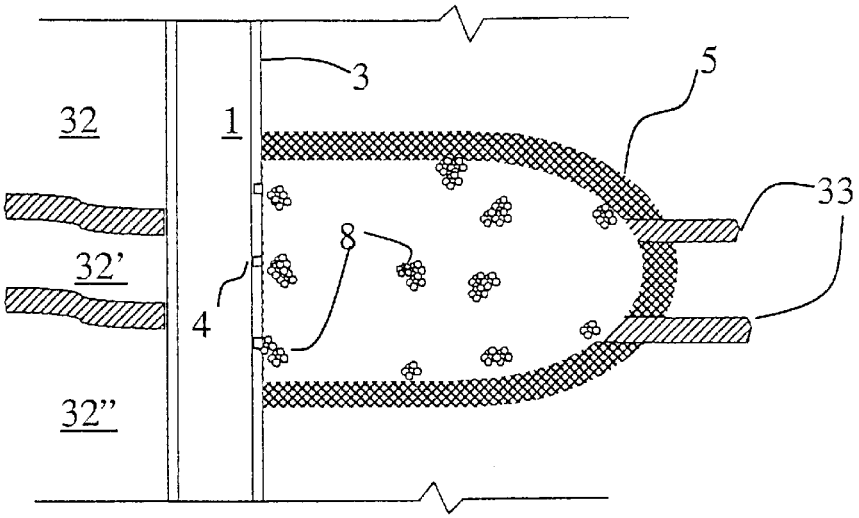
Figure 4-A
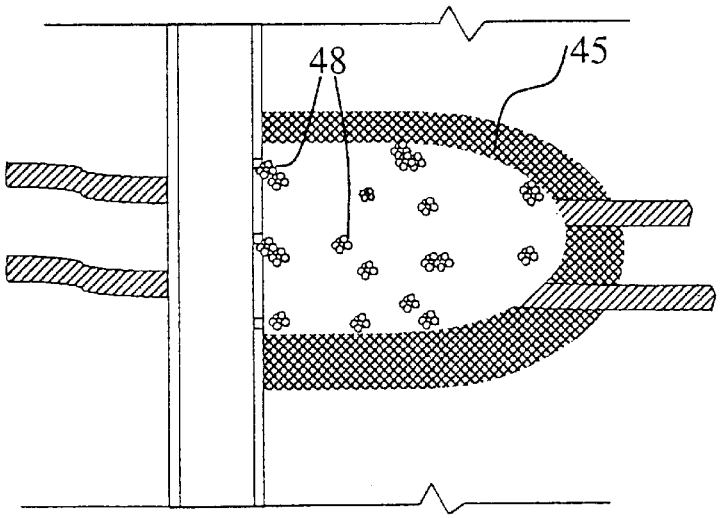
Figure 4-B

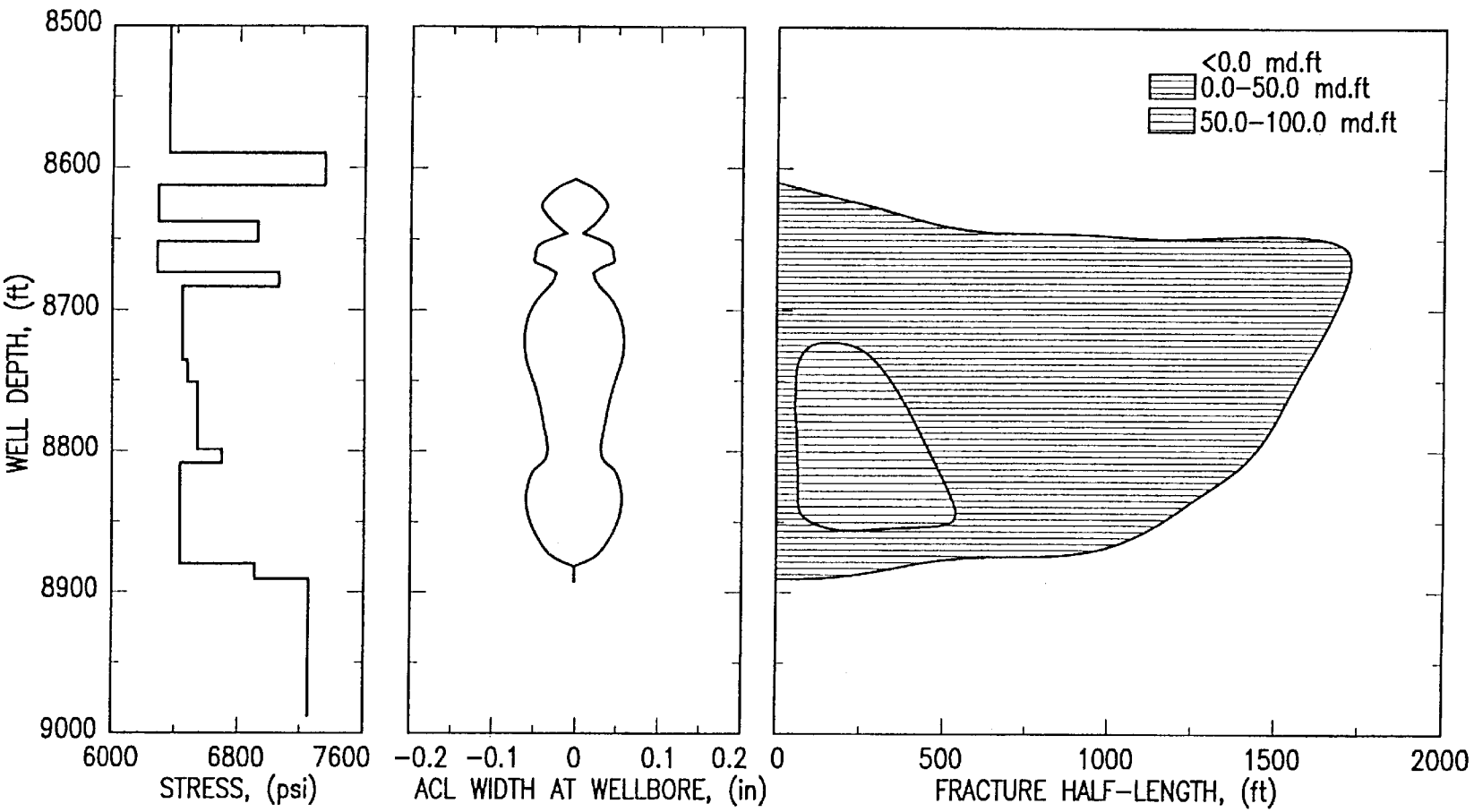
Figure 6–A

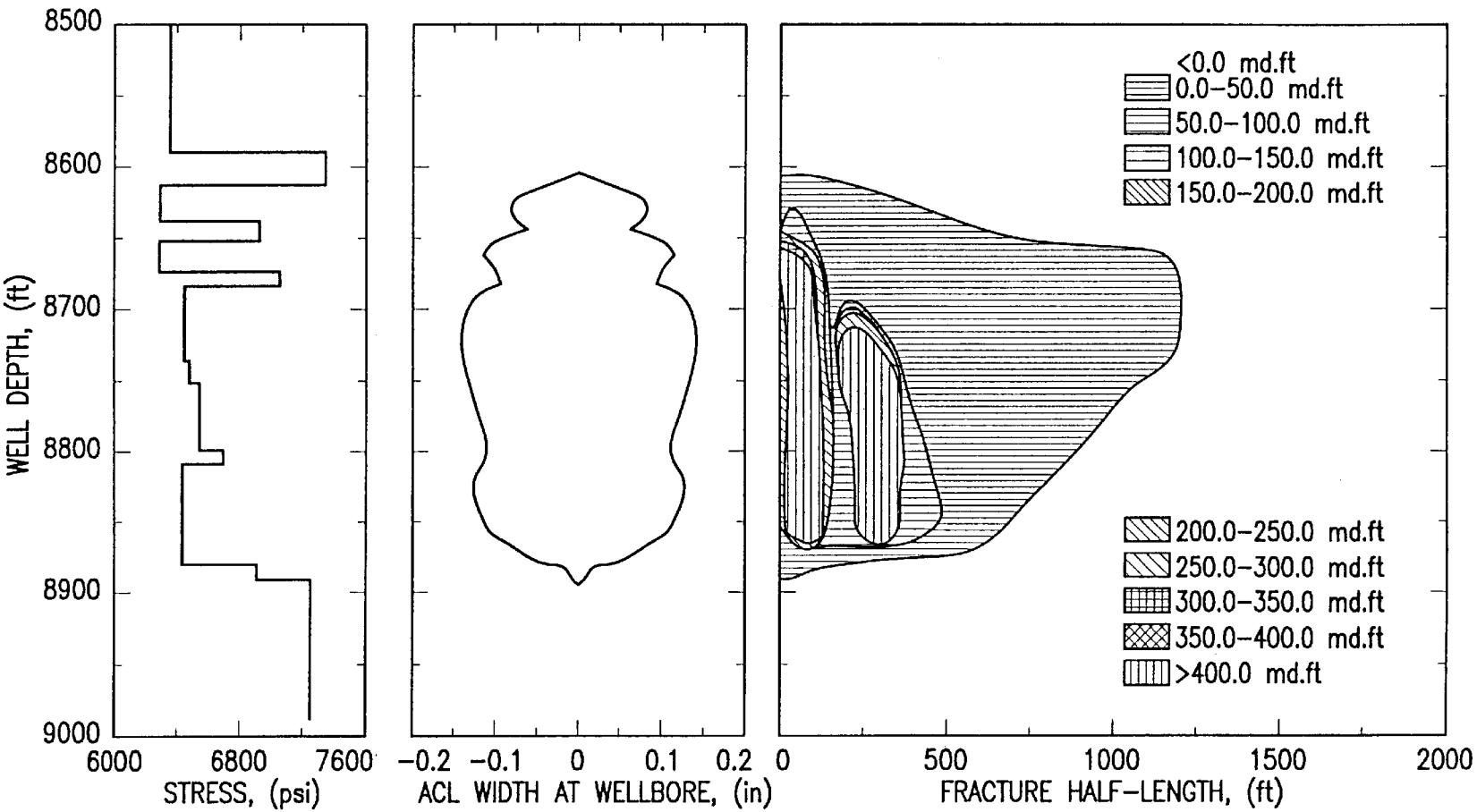
Figure 6-B

HYDRAULIC FRACTURING METHOD

TECHNICAL FIELD OF THE INVENTION

This invention relates generally to the art of hydraulic fracturing in subterranean formations and more particularly to a method and means for optimizing fracture conductivity.

BACKGROUND OF THE INVENTION

Hydrocarbons (oil, natural gas, etc.) are obtained from a subterranean geologic formation (i.e., a "reservoir") by drilling a well that penetrates the hydrocarbon-bearing formation. This provides a partial flowpath for the hydrocarbon to reach the surface. In order for the hydrocarbon to be "produced," that is travel from the formation to the wellbore (and ultimately to the surface), there must be a sufficiently unimpeded flowpath from the formation to the wellbore.

Hydraulic fracturing is a primary tool for improving well productivity by placing or extending channels from the wellbore to the reservoir. This operation is essentially performed by hydraulically injecting a fracturing fluid into a wellbore penetrating a subterranean formation and forcing the fracturing fluid against the formation strata by pressure. The formation strata or rock is forced to crack and fracture. Proppant is placed in the fracture to prevent the fracture from closing and thus, provide improved flow of the recoverable fluid, i.e., oil, gas or water.

The success of a hydraulic fracturing treatment is related to the fracture conductivity. Several parameters are known to affect this conductivity. First, the proppant creates a conductive path to the wellbore after pumping has stopped and the proppant pack is thus critical to the success of a hydraulic fracture treatment. Numerous methods have been developed to improve the fracture conductivity by proper selection of the proppant size and concentration. To improve fracture proppant conductivity, typical approaches include selecting the optimum propping agent. More generally, the most common approaches to improve propped fracture performance include high strength proppants (if the proppant strength is not high enough, the closure stress crushes the proppant, creating fines and reducing the conductivity), large diameter proppants (permeability of a propped fracture increases as the square of the grain diameter), high proppant concentrations in the proppant pack to obtain wider propped fractures.

In an effort to limit the flowback of particulate proppant materials placed into the formation, proppant-retention agents are commonly used so that the proppant remains in the fracture. For instance, the proppant may be coated with a curable resin activated under downhole conditions. Different materials such as fibrous material, fibrous bundles or deformable materials have also used. In the cases of fibers, it is believed that the fibers become concentrated into a mat or other three-dimensional framework, which holds the proppant thereby limiting its flowback. Additionally, fibers contribute to prevent fines migration and consequently, a reduction of the proppant-pack conductivity.

To ensure better proppant placement, it is also known to add a proppant-retention agent, e.g. a fibrous material, a curable resin coated on the proppant, a pre-cured resin coated on the proppant, a combination of curable and pre-cured (sold as partially cured) resin coated on the proppant, platelets, deformable particles, or a sticky proppant coating, to trap proppant particles in the fracture and prevent their production through the fracture and to the wellbore.

Proppant-based fracturing fluids typically also comprise a viscosifier, such as a solvatable polysaccharide to provide sufficient viscosity to transport the proppant. Leaving a highly-viscous fluid in the fracture reduces the permeability of the proppant pack, limiting the effectiveness of the treatment. Therefore, gel breakers have been developed that reduce the viscosity by cleaving the polymer into small molecules fragments. Other techniques to facilitate less damage in the fracture involve the use of gelled oils, foamed fluids or emulsified fluids. More recently, solid-free systems have been developed, based on the use of viscoelastic surfactants as viscosifying agent, resulting in fluids that leave no residues that may impact fracture conductivity.

Numerous attempts have also been made to improve the fracture conductivity by controlling the fracture geometry, for instance to limit its vertical extent and promoting longer fracture length. Since creating a fracture stimulates the production by increasing the effective wellbore radius, the longer the fracture, the greater the effective wellbore radius. Yet many wells behave as though the fracture length were much shorter because the fracture is contaminated with fracturing fluid (i.e., more particularly, the fluid used to deliver the proppant as well as a fluid used to create the fracture, both of which shall be discussed below). The most difficult portion of the fluid to recover is that retained in the fracture tip—i.e. the distal-most portion of the fracture from the wellbore. Thus, the result of stagnant fracturing fluid in the fracture naturally diminishes the recovery of hydrocarbons.

Among the methods proposed to improve fracture geometry, one includes fracturing stages with periods of non-pumping or intermittent sequences of pumping and flowing the well back as described in the U.S. Pat. No. 3,933,205 to Kiel. By multiple hydraulic fracturing, the well productivity is increased. First, a long primary fracture is created, then spalls are formed by allowing the pressure in the fracture to drop below the initial fracturing pressure by discontinuing injection and shutting the well. The injection is resumed to displace the formed spalls along the fracture and again discontinued, and the fracture is propped by the displaced spalls. According to a preferred embodiment, the method is practiced by allowing the well to flow back during at least some portion of the discontinuation of the injection.

Another placement method involves pumping a high viscosity fluid for Pad followed by less viscous fluid for proppant stages. This technique is used for fracturing thin producing intervals when fracture height growth is not desired to help keep the proppant across from the producing formation. This technique, sometimes referred to as "pipeline fracturing", utilizes the improved mobility of the thinner, proppant-laden fluid to channel through the significantly more viscous pad fluid. The height of the proppant-laden fluid is generally confined to the perforated interval. As long as the perforated interval covers the producing formation, the proppant will remain where it is needed to provide the fracture conductivity (proppant that is placed in a hydraulic fracture that has propagated above or below the producing interval is ineffective). This technique is often used in cases where minimum stress differential exists in the intervals bounding the producing formation. Another example would be where a water-producing zone is below the producing formation and the hydraulic fracture will propagate into it. This method cannot prevent the propagation of the fracture into the water zone but may be able to prevent proppant from getting to that part of the fracture and hold it open (this is also a function of the proppant transport capability of the fracturing fluid).

Other methods for improving fracture conductivity are with encapsulated breakers and are described in a number of patents and publications. These methods involve the encapsulation of the active chemical breaker material so that more of it can be added during the pumping of a hydraulic fracturing treatment. Encapsulating the chemical breaker allows its delayed release into the fracturing fluid, preventing it from reacting too quickly so that the viscosity of the fracturing fluid would have been degraded to such an extent that the treatment could not be completed. Encapsulating the active chemical breaker allows for significantly higher amounts to be added which will result in more polymer degradation in the proppant pack. More polymer degradation means better polymer recovery and improved fracture conductivity.

All of the methods described above have limitations. The Kiel method relies on "rock spalling" and creation of multiple fractures to be successful. This technique has most often been applied in naturally fractured formations, in particular, chalk. The theory today governing fracture re-orientation would suggest that the Kiel method could result in separate fractures, but these fractures would orient themselves rather quickly into nearly the same azimuth as the original fracture. The "rock spalling" phenomenon has not shown to be particularly effective (may not exist at all in many cases) in the waterfrac applications over the past several years. The "pipeline fracturing" method is generally limited by the concentration and total amount of proppant that can be pumped in the treatment since the carrying fluid is a low viscosity polymer-based linear gel. The lack of proppant transport will be an issue as will the increased chance for proppant bridging in the fracture due to the lower viscosity fluid. The lower proppant concentration will minimize the amount of conductivity that can be created and the presence of polymer will effectively cause more damage in the narrower fracture.

The development and application of encapsulated breakers results in significant improvement of fracture conductivity. Nevertheless, there is still a limitation as the amount of polymer recovered from a treatment will often not exceed 50% (by weight). Most of the polymer is concentrated in the tip portion of the fracture, that is the portion most distant from the wellbore. This means that the well will produce from a shorter fracture than what was designed and put in place. In all of the above cases the proppant will occupy approximately no less than 65% of the volume of the fracture. This means that no more than 35% of the pore volume can contribute to the fracture conductivity.

It is therefore an object of the present invention to provide an improved method of fracturing and propping a fracture—or a part of a fracture whereby the fracture conductivity is improved and thus, the subsequent production of the well.

SUMMARY OF THE INVENTION

According to the present invention, the well productivity is increased by sequentially injecting into the wellbore alternate stages of fracturing fluids having a contrast in their ability to transport propping agents to improve proppant placement, or having a contrast in the amount of transported propping agents.

The propped fractures obtained following this process have a pattern characterized by a series of bundles of proppant spread along the fracture. In another words, the bundles form "islands" that keep the fracture opens along its length but provide a lot of channels for the formation fluids to circulate.

According to one aspect of the invention, the ability of a fracturing fluid to transport propping agents is defined according to the industry standard. This standard uses a large-scale flow cell (rectangular in shape with a width to simulate that of an average hydraulic fracture) so that fluid and proppant can be mixed (as in field operations) and injected into the cell dynamically. The flow cell has graduations in length both vertically and horizontally enabling the determination of the rate of vertical proppant settling and of the distance from the slot entrance at which the deposition occurs. A contrast in the ability to transport propping agents can consequently be defined by a significant difference in the settling rate (measurement is length/time, ft/min). According to a preferred embodiment of the invention the alternated pumped fluids have a ratio of settling rate of at least 2, preferably of at least 5 and most preferably of at least 10.

Since viscoelastic-based fluids provide exceptionally low settling rate, a preferred way of carrying out the invention is to alternate fluids comprising viscoelastic surfactant and polymer-based fluids.

According to another aspect of the invention, the difference in settling rate is not achieved simply from a static point of view, by modifying the chemical compositions of the fluids but by alternating different pumping rates so that from a dynamic point of view, the apparent settling rate of the proppant in the fracture will be altered.

A combination of the static and dynamic approach may also be considered. In other words, the preferred treatment consists in alternating sequences of a first fluid, having a low settling rate, pumped at a first high pumping rate and of a second fluid, having a higher settling rate and pumped at a lower pumping rate. This approach may be in particular preferred where the ratio of the settling rates of the different fluids is relatively small. If the desired contrast in proppant settling rate is not achieved, the pump rate may be adjusted in order to obtain the desired proppant distribution in the fracture. In the most preferred aspect, the design is such that a constant pump rate is maintained for simplicity.

As an alternative aspect the pump rate may be adjusted to control the proppant settling. It is also possible to alternate proppants of different density to control the proppant settling and achieve the desired distribution. In even another aspect the base-fluid density may be altered to achieve the same result. This is because the alternating stages put the proppant where it will provide the best conductivity. An alternating "good transport" and "poor transport" is dependent of five main variables—proppant transport capability of the fluid, pump rate, density of the base-fluid, diameter of the proppant and density of the proppant. By varying any or all of these, the desired result may be achieved. The simplest case, and therefore preferred, is to have fluids with different proppant transport capability and keep the pump rate, base-fluid density and proppant density constant.

According to another embodiment of the invention, the proppant transport characteristics are de-facto altered by significantly changing the amount of proppant transported. For instance, proppant-free stages are alternated with the proppant-stages. This way, the propped fracture pattern is characterized by a series of post-like bundles that strut the fracture essentially perpendicular to the length of the fracture.

The invention provides an effective means to improve the conductivity of a propped hydraulic fracture and to create a longer effective fracture half-length for the purpose of increasing well productivity and ultimate recovery.

The invention uses alternating stages of different fluids in order to maximize effective fracture half-length and fracture conductivity. The invention is intended to improve proppant placement in hydraulic fractures to improve the effective conductivity, which in-turn improves the dimensionless fracture conductivity leading to improved stimulation of the well. The invention can also increase the effective fracture half-length, which in lower permeability wells, will result in increased drainage area.

The invention relies on the proper selection of fluids in order to achieve the desired results. The alternating fluids will typically have a contrast in their ability to transport propping agents. A fluid that has poor proppant transport characteristics can be alternated with an excellent proppant transport fluid to improve proppant placement in the fracture.

The alternate stages of fluid of the invention are applied to the proppant carrying stages of the treatment, also called the slurry stages, as the intent is to alter the proppant distribution on the fracture to improve length and conductivity. As an example, portions of a polymer-based proppant-carrier fluid may be replaced with a non-damaging viscoelastic surfactant fluid system. Alternating slurry stages alters the final distribution of proppant in the hydraulic fracture and minimizes damage in the proppant pack allowing the well to attain improved productivity.

According to a preferred embodiment, a polymer-based fluid system is used for the pad fluid in these cases in order to generate sufficient hydraulic fracture width and provide better fluid loss control. The invention may also carried out with foams, that is fluids that in addition of the other components comprise a gas such as nitrogen, carbon dioxide, air or a combination thereof. Either or both stages can be foamed with any of the gas. Since foaming may affect the proppant transport ability, one way of carrying out the invention is by varying the foam quality (or volume of gas per volume of base fluid).

According to a preferred embodiment, this method based on pumping alternating fluid systems during the proppant stages is applied to fracturing treatments using long pad stages and slurry stages at very low proppant concentration and commonly known as "waterfracs", as described for instance in the SPE Paper 38611, or known also in the industry as "slickwater" treatment or "hybrid waterfrac treatment". As described in the term "waterfrac" as used herein covers fracturing treatment with a large pad volume (typically of about 50% of the total pumped fluid volume and usually no less than where at least 30% of the total pumped volume), a proppant concentration not exceeding 2 lbs/gal, constant (and in that case lower than 1 lb/gal and preferably of about 0.5 lbs/gal) or ramp through proppant-laden stages, the base fluid being either a "treated water" (water with friction-reducer only) or comprising a polymer-base fluid at a concentration of between 5 to 15 lbs/Mgal).

BRIEF DESCRIPTION OF THE DRAWINGS

The above and further objects, features and advantages of the present invention will be better understood by reference to the appended detailed description, and to the drawings wherein:

FIG. 1 shows the proppant distribution following a waterfrac treatment according to the prior art;

FIG. 2 shows the proppant distribution as a result of alternating proppant-fluid stage according to the invention;

FIG. 3 shows the proppant distribution following a treatment of a multilayered formation according to the prior art;

FIG. 4 shows the proppant distribution following a treatment of a multilayered formation according to the invention.

FIG. 6 shows the fracture profile and conductivity (using color drawings) for a well treated according to the prior art (FIG. 6-A) or according to the invention (FIG. 6-B).

DETAILED DESCRIPTION AND PREFERRED EMBODIMENTS

Figure 5:
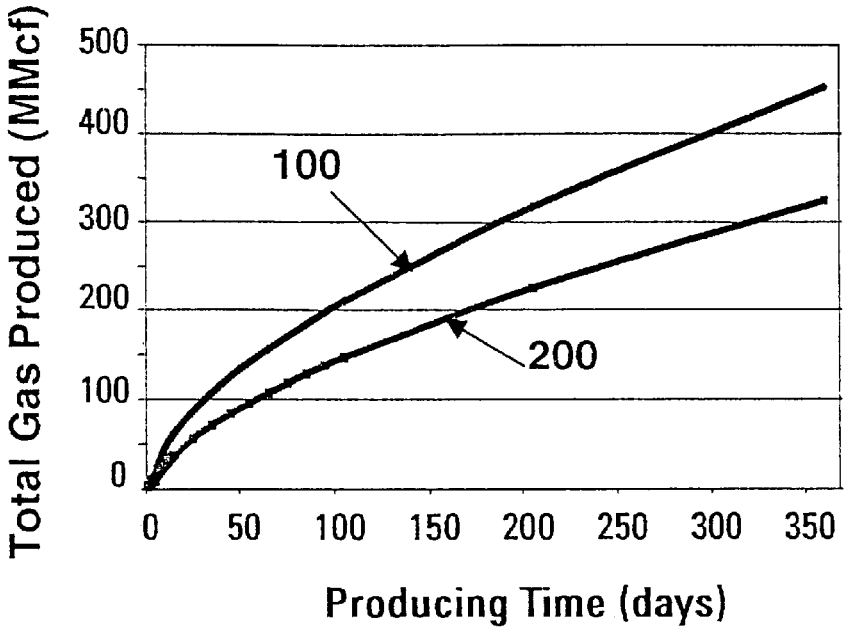
FIG. 5 shows the expected gas production following a treatment according to the invention and a treatment according to a "waterfrac" treatment along the prior art.

In most cases, a hydraulic fracturing treatment consists in pumping a proppant-free viscous fluid, or pad, usually water with some fluid additives to generate high viscosity, into a well faster than the fluid can escape into the formation so that the pressure rises and the rock breaks, creating artificial fracture and/or enlarging existing fracture. Then, a propping agent such as sand is added to the fluid to form a slurry that is pumped into the fracture to prevent it from closing when the pumping pressure is released. The proppant transport ability of a base fluid depends on the type of viscosifying additives added to the water base.

Water-base fracturing fluids with water-soluble polymers added to make a viscosified solution are widely used in the art of fracturing. Since the late 1950s, more than half of the fracturing treatments are conducted with fluids comprising guar gums, high-molecular weight polysaccharides composed of mannose and galactose sugars, or guar derivatives such as hydropropyl guar (HPG), carboxymethyl guar (CMG). carboxymethylhydropropyl guar (CMHPG). Crosslinking agents based on boron, titanium, zirconium or aluminum complexes are typically used to increase the effective molecular weight of the polymer and make them better suited for use in high-temperature wells.

To a smaller extent, cellulose derivatives such as hydroxyethylcellulose (HEC) or hydroxypropylcellulose (HPC) and carboxymethylhydroxyethylcellulose (CMHEC) are also used, with or without crosslinkers. Xanthan and scleroglucan, two biopolymers, have been shown to have excellent proppant-suspension ability even though they are more expensive than guar derivatives and therefore used less frequently. Polyacrylamide and polyacrylate polymers and copolymers are used typically for high-temperature applications or friction reducers at low concentrations for all temperatures ranges.

Polymer-free, water-base fracturing fluids can be obtained using viscoelastic surfactants. These fluids are normally prepared by mixing in appropriate amounts suitable surfactants such as anionic, cationic, nonionic and zwitterionic surfactants. The viscosity of viscoelastic surfactant fluids is attributed to the three dimensional structure formed by the components in the fluids. When the concentration of surfactants in a viscoelastic fluid significantly exceeds a critical concentration, and in most cases in the presence of an electrolyte, surfactant molecules aggregate into species such as micelles, which can interact to form a network exhibiting viscous and elastic behavior.

Cationic viscoelastic surfactants—typically consisting of long-chain quaternary ammonium salts such as cetyltrimethylammonium bromide (CTAB)—have been so far of primarily commercial interest in wellbore fluid. Common reagents that generate viscoelasticity in the surfactant solutions are salts such as ammonium chloride, potassium chloride, sodium chloride, sodium salicylate and sodium isocyanate and non-ionic organic molecules such as chloroform. The electrolyte content of surfactant solutions is also an important control on their viscoelastic behavior. Reference is made for example to U.S. Pat. No. 4,695,389, U.S.

Pat. No. 4,725,372, U.S. Pat. No. 5,551,516, U.S. Pat. No. 5,964,295, and U.S. Pat. No. 5,979,557. However, fluids comprising this type of cationic viscoelastic surfactants usually tend to lose viscosity at high brine concentration (10 pounds per gallon or more). Therefore, these fluids have seen limited use as gravel-packing fluids or drilling fluids, or in other applications requiring heavy fluids to balance well pressure. Anionic viscoelastic surfactants are also used.

It is also known from International Patent Publication WO 98/56497, to impart viscoelastic properties using amphoteric/zwitterionic surfactants and an organic acid, salt and/or inorganic salt. The surfactants are for instance dihydroxyl alkyl glycinate, alkyl ampho acetate or propionate, alkyl betaine, alkyl amidopropyl betaine and alkylamino mono- or di-propionates derived from certain waxes, fats and oils. The surfactants are used in conjunction with an inorganic water-soluble salt or organic additives such as phthalic acid, salicylic acid or their salts. Amphoteric/zwitterionic surfactants, in particular those comprising a betaine moiety are useful at temperature up to about 150° C. and are therefore of particular interest for medium to high temperature wells. However, like the cationic viscoelastic surfactants mentioned above, they are usually not compatible with high brine concentration.

According to a preferred embodiment of the invention, the treatment consists in alternating viscoelastic-base fluid stages (or a fluid having relatively poor proppant capacity, such as a polyacrylamide-based fluid, in particular at low concentration) with stages having high polymer concentrations. Preferably, the pumping rate is kept constant for the different stages but the proppant-transport ability may be also improved (or alternatively degraded) by reducing (or alternatively increasing) the pumping rate.

The proppant type can be sand, intermediate strength ceramic proppants (available from Carbo Ceramics, Norton Proppants, etc.), sintered bauxites and other materials known to the industry. Any of these base propping agents can further be coated with a resin (available from Santrol, a Division of Fairmount Industries, Borden Chemical, etc.) to potentially improve the clustering ability of the proppant. In addition, the proppant can be coated with resin or a proppant flowback control agent such as fibers for instance can be simultaneously pumped. By selecting proppants having a contrast in one of such properties such as density, size and concentrations, different settling rates will be achieved.

An example of a "waterfrac" treatment is illustrated in FIGS. 1-A and 1-B. "Waterfrac" treatments employ the use of low cost, low viscosity fluids in order to stimulate very low permeability reservoirs. The results have been reported to be successful (measured productivity and economics) and rely on the mechanisms of asperity creation (rock spalling), shear displacement of rock and localized high concentration of proppant to create adequate conductivity. It is the last of the three mechanisms that is mostly responsible for the conductivity obtained in "waterfrac" treatments. The mechanism can be described as analogous to a wedge splitting wood.

FIG. 1-A is a schematic view of a fracture during the fracturing process. A wellbore 1, drilling through a subterranean zone 2 that is expected to produce hydrocarbons, is cased and a cement sheath 3 is placed in the annulus between the casing and the wellbore walls. Perforations 4 are provided to establish a connection between the formation and the well. A fracturing fluid is pumped downhole at a rate and pressure sufficient to form a fracture 5 (side view). With such a waterfrac treatment according to the prior art, the proppant 6 tends to accumulate at the lower portion of the fracture near the perforations.

The wedge of proppant happens because of the high settling rate in a poor proppant transport fluid and low fracture width as a result of the in-situ rock stresses and the low fluid viscosity. The proppant will settle on a low width point and accumulate with time. The hydraulic width (width of the fracture while pumping) will allow for considerable amounts to be accumulated prior to the end of the job. After the job is completed and pumping is ceased the fracture will try and close as the pressure in the fracture decreases. The fracture will be held open by the accumulation of proppant as shown in the following FIG. 1-A. Once the pressure is released, as shown FIG. 1-B, the fracture 15 shrinks both in length and height, slightly packing down the proppant 16 that remains in the same location near the perforations. The limitation in this treatment is that as the fracture closes after pumping, the "wedge of proppant" can only maintain an open (conductive) fracture for some distance above and laterally away. This distance depends on the formation properties (Young's Modulus, in-situ stress, etc.) and the properties of the proppant (type, size, concentration, etc.)

The method of this invention aids in redistribution of the proppant by effecting the wedge dynamically during the treatment. For this example a low viscosity waterfrac fluid is alternated with a low viscosity viscoelastic fluid which has excellent proppant transport characteristics. The alternating stages of viscoelastic fluid will pick up, re-suspend and transport some of the proppant wedge that has formed near the wellbore due to settling after the first stage. Due to the viscoelastic properties of the fluid the alternating stages pick up the proppant and form localized clusters (similar to the wedges) and redistribute them farther up and out into the hydraulic fracture. This is illustrated FIGS. 2-A and 2-B that again represents the fracture during pumping (2-A) and after pumping (2-B) and where the clusters 8 of proppant are spread out along a large fraction (if not all) of the fracture length. As a result, when the pressure is released, the clusters 28 remain spread along the whole fracture and minimize the shrinkage of the fracture 25.

The fluid systems can be alternated many times to achieve varied distribution of the clusters in the hydraulic fracture. This phenomenon will create small pillars in the fracture that will help keep more of the fracture open and create higher overall conductivity and effective fracture half-length.

In another "waterfrac" related application it is possible to just move the proppant out laterally away from the wellbore in order to achieve a longer effective fracture half-length.

The invention is particularly useful in multi-layered formations with varying stress. This will often end up with the same effect as above. This is due to the fact that there are several points of limited hydraulic fracture width along the fracture height due to intermittent higher stress layers. This idea is illustrated FIGS. 3 and 4 that are similar to FIGS. 1 & 2, representative of a single-layer formation where the producing zone is continuous with no breaks in lithology. In FIGS. 3 and 4, the case represented in FIGS. 1 and 2 is essentially repeating itself: the wellbore 1 is drilling through 3 production zones 32, 32' and 32" isolated by intervals of shales or other non-productive zones 33. Perforations 4 are provided for each of the production zones to bypass the cement sheath 3.

According to the priort art, as long as the fracture pressure is kept (FIG. 3A) a large fracture 5 that encompasses the different productions zone is formed, with a cluster (6, 6' and 6") of proppant settling near each perforation 4. When the pressure is released (FIG. 3B), the position of the clusters remains essentially unchanged (36, 36' and 36") so that there is typically not enough proppant to keep the whole fracture open and as a result, small fractures 35, 35' and 35", without intercommunicatiion. The producing zone is broken up by the presence of non-productive higher stress intervals.

By using a combination of fluids that will pick-up, transport and redistribute the proppant it is possible to remediate the negative impact of the short effective fracture half-length and may even possibly eliminate the fracture closing across from the high stress layers. The fracture can close across the higher stress layers illustrated in FIG. 3 because of lack of vertical proppant coverage in the fracture. In fluid stages alternated between the various fluid types it is possible to achieve the following post-treatment proppant coverage in the fracture as shown FIG. 4: the multiplicity of proppant clusters 8 formed during the pressure stage minimizes the closure of the fracture so that the final fracture 48 held by the clusters 48.

There are many different combinations of fluid systems that can be used to achieve the desired results based on reservoir conditions. In the least dramatic case it would be beneficial to pick-up sand from the bank that has settled and move it laterally away from the wellbore. The various combinations of fluids and proppants can be designed based on individual well conditions to obtain the optimum well production.

The following example illustrates the invention by running two simulations. The first simulation is based on a waterfrac treatment according to the prior art. The second simulation is based on a treatment according to the invention where fluids of different proppant-transport ability are alternated.

In the first conventional pumping schedule, a polymer-base fluid is pumped at a constant rate of 35 bbl/min. Table I shows the volume pumped per stage, the quantity of proppant (in pounds per gallons of base fluid or ppa), the corresponding proppant mass and the pumping time. The total pumped volume is 257520 gallons, with a proppant mass of 610000 lbs in a pumping time of 193.9 minutes. The polymer-base fluid is a 20 lbs/1000 gallons of an uncrosslinked guar.

TABLE I

| Stages | Fluid | Volume (gallons) | Proppant concentration (ppa) | Proppant mass (lbs) | Slurry Volume (bbl) | Pumping Time |
|---|---|---|---|---|---|---|
| Pad | Polymer | 100000 | 0.0 | 0 | 2381.0 | 68.0 |
| 1 | Polymer | 20000 | 1.0 | 20000 | 497.7 | 14.2 |
| 2 | Polymer | 20000 | 2.0 | 40000 | 519.3 | 14.8 |
| 3 | Polymer | 30000 | 3.0 | 90000 | 811.2 | 23.2 |
| 4 | Polymer | 30000 | 4.0 | 120000 | 843.5 | 24.1 |
| 5 | Polymer | 20000 | 5.0 | 100000 | 583.9 | 16.7 |
| 6 | Polymer | 15000 | 6.0 | 90000 | 454.0 | 13.0 |
| 7 | Polymer | 10000 | 7.0 | 70000 | 313.5 | 9.0 |
| 8 | Polymer | 10000 | 8.0 | 80000 | 324.2 | 9.3 |
| Flush | Polymer | 2520 | 0.0 | 0 | 60.0 | 1.7 |

As shown in Table II, in the second stimulation, according to the invention, was run by splitting each stage into two to pump alternatively a polymer-base fluid and a viscoelastic (or VES) base fluid at 3% of erucyl methyl(bis) 2-hydroxyethyl ammonium chloride. The volumes, proppant concentration and pumping rate were kept the same as in the simulation shown Table I.

TABLE II

| Stages | Fluid | Volume (gallons) | Proppant concentration (ppa) | Proppant mass (lbs) | Slurry Volume (bbl) | Pumping Time |
|---|---|---|---|---|---|---|
| Pad | Polymer | 100000 | 0.0 | 0 | 2381.0 | 68.0 |
| 1 | Polymer | 15000 | 1.0 | 15000 | 373.3 | 10.7 |
| 1a | VES | 5000 | 1.0 | 5000 | 124.4 | 3.6 |
| 2 | Polymer | 15000 | 2.0 | 30000 | 389.4 | 11.1 |
| 2a | VES | 5000 | 2.0 | 10000 | 129.8 | 3.7 |
| 3 | Polymer | 20000 | 3.0 | 60000 | 540.8 | 15.5 |
| 3a | VES | 10000 | 3.0 | 30000 | 270.4 | 7.7 |
| 4 | Polymer | 20000 | 4.0 | 80000 | 562.3 | 16.1 |
| 4a | VES | 10000 | 4.0 | 40000 | 281.2 | 8.0 |
| 5 | Polymer | 15000 | 5.0 | 75000 | 437.9 | 12.5 |
| 5a | VES | 5000 | 5.0 | 25000 | 146.0 | 4.2 |
| 6 | Polymer | 10000 | 6.0 | 60000 | 302.7 | 8.6 |
| 6a | VES | 5000 | 6.0 | 30000 | 151.3 | 4.3 |
| 7 | Polymer | 5000 | 7.0 | 35000 | 156.7 | 4.5 |
| 7a | VES | 5000 | 7.0 | 35000 | 156.7 | 4.5 |
| 8 | Polymer | 5000 | 8.0 | 40000 | 162.1 | 4.6 |
| 8a | VES | 5000 | 8.0 | 40000 | 162.1 | 4.6 |
| Flush | Polymer | 2520 | 0.0 | 0 | 60.0 | 1.7 |

The forecasted cumulative gas production expected when using the pumping schedules according to tables 1 and 2 is represented FIG. 5. The schedule according to the invention is expected to provide a cumulative production far superior to the production expected with a treatment according the art.

A simulation was further carried out to illustrate the formation of "posts" in the fracture. FIGS. 6 and 7 show the fracture profiles and fracture conductivity predicted by a simulation tool, using a "waterfrac" pumping schedule according to the prior art (table III) or using a pumping schedule according to the invention (table IV). As for the preceding cases, the schedule according to the invention is essentially obtained by splitting the stages of the schedule according to the prior art. To be noted that in both cases, the pumping rate is assumed to be equal to 60.0 bbl/min and that the polymer fluid (table III and IV) comprises 30 lbs/1000 gallon of un-crosslinked guar and the VES fluid (table IV) is a solution at 4% of erucyl methyl(bis) 2-hydroxyethyl ammonium chloride. Both schedules deliver the same total proppant mass, total slurry volume and total pumping time.

TABLE III

| Stages | Fluid | Volume (gallons) | Proppant concentration (ppa) | Proppant mass (lbs) | Slurry Volume (bbl) | Pumping Time |
|---|---|---|---|---|---|---|
| Pad | Polymer | 150000 | 0.0 | 0 | 3571.4 | 59.5 |
| 1 | Polymer | 20000 | 1.0 | 20000 | 497.7 | 8.3 |
| 2 | Polymer | 20000 | 2.0 | 40000 | 519.3 | 8.7 |
| 3 | Polymer | 25000 | 3.0 | 75000 | 676.0 | 11.3 |
| 4 | Polymer | 25000 | 4.0 | 100000 | 702.9 | 11.7 |
| 5 | Polymer | 20000 | 5.0 | 125000 | 729.8 | 12.2 |
| 6 | Polymer | 10000 | 6.0 | 60000 | 302.7 | 5.0 |
| Flush | Polymer | 5476 | 0.0 | 0 | 130.4 | 2.2 |

TABLE IV

| Stages | Fluid | Volume (gallons) | Proppant concentration (ppa) | Proppant mass (lbs) | Slurry Volume (bbl) | Pumping Time |
|---|---|---|---|---|---|---|
| Pad | Polymer | 150000 | 0.0 | 0 | 3571.4 | 59.5 |
| 1 | Polymer | 15000 | 1.0 | 15000 | 373.3 | 6.2 |
| 1a | VES | 5000 | 1.0 | 5000 | 124.4 | 2.1 |

TABLE IV-continued

| Stages | Fluid | Volume (gallons) | Proppant concentration (ppa) | Proppant mass (lbs) | Slurry Volume (bbl) | Pumping Time |
|---|---|---|---|---|---|---|
| 2 | Polymer | 15000 | 2.0 | 30000 | 389.4 | 6.5 |
| 2a | VES | 5000 | 2.0 | 10000 | 129.8 | 2.2 |
| 3 | Polymer | 15000 | 3.0 | 45000 | 405.6 | 6.8 |
| 3a | VES | 10000 | 3.0 | 30000 | 270.4 | 4.5 |
| 4 | Polymer | 15000 | 4.0 | 60000 | 562.3 | 7.0 |
| 4a | VES | 10000 | 4.0 | 40000 | 281.2 | 4.7 |
| 5 | Polymer | 15000 | 5.0 | 75000 | 437.9 | 7.3 |
| 5a | VES | 10000 | 5.0 | 50000 | 291.9 | 4.9 |
| 6 | Polymer | 5000 | 6.0 | 30000 | 151.3 | 2.5 |
| 6a | VES | 5000 | 6.0 | 30000 | 151.3 | 2.5 |
| Flush | Polymer | 5476 | 0.0 | 0 | 130.4 | 2.2 |

Where the two pumping schedules shown above in table III and IV are applied to a well having a profile as schematized in the left part of FIG. 6, completely different fracture profiles are achieved. As it can be seen in comparing FIGS. 6-A and 6-B, the invention provides a much wider fracture. Moreover, the colored diagrams in the right part show that the conductivity in the fracture obtained with a conventional treatment is systematically in the "blue" zone, indicative of a conductivity not exceeding 150 md.ft. On the other hand, the fracture according to the invention presents essentially two posts where the conductivity is in the "orange" zone, in the range of about 350–400 md.ft. Moreover, the zone of highest conductivity is about twice as high as in the conventional treatment.

Having described, I claim:

1. A method for fracturing a subterranean formation comprising sequentially injecting into a wellbore, alternate stages of proppant-containing fracturing fluids having a contrast in their ability to transport propping agents to improve proppant placement.

2. The method of claim 1, wherein said contrast is obtained by selecting proppants having a contrast in at least one of the following properties: density, size and concentration.

3. The method of claim 1, wherein the proppant-settling rate is control by adjusting the pumping rates.

4. The method of claim 1, wherein the proppant-containing fracturing fluids comprise viscosifying agents of different natures.

5. The method of claim 4, wherein alternate stages of proppant-containing fracturing fluids comprise different viscosifying agents selected from the list consisting of polymers and viscoelastic surfactants.

6. The method of claim 5 comprising alternating proppant-stages and proppant-free stages.

7. A method for fracturing a subterranean formation comprising sequentially injecting into a wellbore, alternate stages of proppant-containing fracturing fluids having a contrast in their proppant-settling rates.

8. The method of claim 7, wherein the fracturing fluids, injected during the alternate stages, have a proppant-settling ratio of at least 2.

9. The method of claim 8, wherein the fracturing fluids injected during the alternate stages have a settling ratio of at least 5.

10. The method of claim 9, wherein the fracturing fluids injected during the alternate stages have a settling ratio of at least 10.

11. The method of claim 1 or 2, further comprising a pad stage.

12. A method for fracturing a subterranean formation comprising sequentially injecting into a wellbore, alternate stages of proppant-containing fracturing fluids having a contrast in their ability to transport propping agents, said different stages of proppant-containing fracturing fluids at different pumping rates so that the settling rate of proppant will be different during the alternated stages.

13. A method for fracturing a subterranean formation comprising sequentially injecting into a wellbore, alternate stages of proppant-containing fracturing fluids having a contrast in their ability to transport propping agents, said different stages of proppant-containing fracturing fluids with proppants of varying density so that the settling rate of proppant will be different during the altered stages.

14. A method for fracturing a subterranean formation comprising sequentially injecting into a wellbore, alternate stages of proppant-containing fracturing fluids having a contrast in their ability to transport propping agents, said different stages of proppant-containing fracturing fluids with base-fluids of varying density so that the settling rate of proppant will be different during the altered stages.

15. A method for fracturing a subterranean formation comprising sequentially injecting into a wellbore, alternate stages of proppant-containing fracturing fluids having a contrast in their ability to transport propping agents, said different stages of proppant-containing fracturing fluids with fluids of varying foam qualities so that the settling rate of proppant will be different during the altered stages.

16. A method for fracturing a subterranean formation comprising sequentially injecting into a wellbore, alternate stages of fracturing fluids with a first content of transported propping agents and fracturing fluids with a second content of transported propping agents, said first and second contents in a ratio of at least 2.

17. A propped fracture in a subterranean formation comprising at least two bundles of proppant spaced alone the length of the fracture said bundles forming posts having a height essentially perpendicular to the length of the fracture.

18. A method for fracturing a subterranean formation comprising sequentially injecting into a wellbore, different stages of proppant-containing fracturing fluids at different pumping rates so that the settling rate of proppant will be different during the alternated stages.

* * * * *